US011759390B2

(12) United States Patent
Brader

(10) Patent No.: US 11,759,390 B2
(45) Date of Patent: Sep. 19, 2023

(54) LUNG GAS EXCHANGE DEVICE

(71) Applicant: Eric William Brader, Sewickley, PA (US)

(72) Inventor: Eric William Brader, Sewickley, PA (US)

( * ) Notice: Subject to any disclaimer, the term of this patent is extended or adjusted under 35 U.S.C. 154(b) by 89 days.

(21) Appl. No.: 17/175,134

(22) Filed: Feb. 12, 2021

(65) Prior Publication Data

US 2021/0186804 A1 Jun. 24, 2021

Related U.S. Application Data

(63) Continuation of application No. 15/072,695, filed on Mar. 17, 2016, now Pat. No. 10,966,902.

(Continued)

(51) Int. Cl.
*A61H 23/02* (2006.01)
*A61H 31/00* (2006.01)

(52) U.S. Cl.
CPC ..... *A61H 23/0263* (2013.01); *A61H 23/02* (2013.01); *A61H 31/00* (2013.01); *A61H 2201/0107* (2013.01); *A61H 2201/165* (2013.01); *A61H 2201/169* (2013.01); *A61H 2201/1609* (2013.01); *A61H 2201/1611* (2013.01); *A61H 2201/1645* (2013.01); *A61H 2201/1671* (2013.01); *A61H 2201/5005* (2013.01); *A61H 2201/5007* (2013.01); *A61H 2201/5064* (2013.01); *A61H 2201/5084* (2013.01); *A61H 2201/5089* (2013.01); *A61H 2201/5097* (2013.01); *A61H 2205/04* (2013.01);

(Continued)

(58) Field of Classification Search
CPC .... A61H 23/0263; A61H 23/02; A61H 31/00; A61H 2201/0107; A61H 2201/1609; A61H 2201/1611; A61H 2201/1645; A61H 2201/165; A61H 2201/1671; A61H 2201/169; A61H 2201/5005; A61H 2201/5007; A61H 2201/5064; A61H 2201/5084; A61H 2201/5089; A61H 2201/5097; A61H 2205/04; A61H 2230/065; A61H 2230/206; A61H 2230/208; A61H 2230/405; A61H 2230/505

See application file for complete search history.

(56) References Cited

U.S. PATENT DOCUMENTS 3,710,784 A * 1/1973 Taylor ..... A61H 23/0263 601/18
4,052,981 A * 10/1977 Bachmann ..... A61H 23/0263 601/134

(Continued)

*Primary Examiner* — Timothy A Stanis
*Assistant Examiner* — Matthew R Moon
(74) *Attorney, Agent, or Firm* — Gerard M. Donovan; Sidharth Kapoor; Reed Smith LLP

(57) ABSTRACT

A lung gas exchange device includes a front housing, at least one strap configured to affix the front housing to an anterior neck of a user, a vibration device positioned within the front housing, a wear plate configured to transfer vibration from the vibration device to the anterior neck of the user, a power source configured to provide power to the vibration device, a power control mechanism configured to allow a user to turn on and off the vibration device; and a central processing unit board connected to the power control mechanism, the power source, and the vibration device.

18 Claims, 5 Drawing Sheets

Related U.S. Application Data

(60) Provisional application No. 62/134,385, filed on Mar. 17, 2015.

(52) U.S. Cl.
CPC .. *A61H 2230/065* (2013.01); *A61H 2230/206* (2013.01); *A61H 2230/208* (2013.01); *A61H 2230/405* (2013.01); *A61H 2230/425* (2013.01); *A61H 2230/505* (2013.01)

(56) References Cited

U.S. PATENT DOCUMENTS

| | | | | |
|---|---|---|---|---|
| 6,254,560 | B1 * | 7/2001 | Tweardy | A61F 5/055 602/18 |
| 9,943,461 | B1 * | 4/2018 | Muench | A61H 31/006 |
| 10,966,902 | B2 * | 4/2021 | Brader | A61H 23/0263 |
| 2005/0261612 | A1 * | 11/2005 | Hazan | A61H 23/0245 601/84 |
| 2008/0251084 | A1 * | 10/2008 | Marchetto | A61F 5/055 602/17 |
| 2012/0253236 | A1 * | 10/2012 | Snow | A61N 5/0618 601/2 |
| 2013/0197409 | A1 * | 8/2013 | Baxter | A61M 5/422 601/46 |
| 2013/0331745 | A1 * | 12/2013 | Sedic | A61H 23/00 601/46 |
| 2015/0157532 | A1 * | 6/2015 | Smith | A61H 23/0263 601/46 |

* cited by examiner

LUNG GAS EXCHANGE DEVICE

PRIORITY CLAIM

This application is a Continuation of U.S. application Ser. No. 15/072,695, filed Mar. 17, 2016 which claims the benefit of U.S. Provisional Application No. 62/134,385, filed Mar. 17, 2015, the disclosure of which is incorporated herein by reference in its entirety.

BACKGROUND

Chronic respiratory diseases, such as Chronic Obstructive Pulmonary Disease (COPD), affect at least twelve million people in the United States. Chronic respiratory diseases are characterized by obstruction to airflow that interferes with normal breathing. Patients with severe chronic respiratory disease are disabled by the inability of their diseased lungs to efficiently perform gas exchange. Of those affected, over half report that symptoms impair their ability to perform activities of daily living.

COPD is a disease state where gas exchange, including both oxygen absorption and carbon-dioxide elimination, is reduced. COPD typically worsens over time, further reducing the ability of a patient's lungs to exchange gas. As a patient's disease worsens, it limits their ability to function in daily life. Once a patient's lung function drops below 30%, his or her quality of life can significantly decline, making it difficult to even walk down the street or carry things without running out of breath. Eventually, a patient will be unable to even get up and move around. At around 15% lung function, patients have extreme increased work in breathing and the disease quickly becomes non-survivable.

COPD is the third most common cause of death in the United States and the cause of a substantial economic burden on individuals and society. As explained in "The Clinical and Economic Burden of Chronic Obstructive Pulmonary Disease in the USA," by Anthony J Guarascio, Shaunta M. Ray, Christopher K. Finch, and Timothy H. Self (published online Jun. 17, 2013), the cost of COPD in the USA was projected to be approximately $50 billion in 2010, which included $20 billion in indirect costs and $30 billion in direct health care expenditures.

It is believed that in patients with COPD, carbon dioxide aggregates form in poorly stirred alveoli. These aggregates are believed to form from weak dipole-dipole interactions between carbon dioxide molecules. Such aggregates, particularly if left undisturbed by mechanical forces, could form progressively deepening confluent layers resting on the inner surface of the alveolus, increasingly widening the diffusion barrier. Vibration of the alveoli and the gas being exchanged is known to improve gas exchange in the lung. Known devices for improving gas exchange by vibration, however, are inconvenient to use, expensive, and do not effectively vibrate both the alveoli and the gas being exchanged.

For example, a high-frequency chest wall oscillation device, such as a ThAlRaphy Vest, has been used to oscillate the chest to help gas exchange. The device is a pneumatic vest that can be placed around a patient's chest to rapidly oscillate pressure to help vibrate the alveoli to increase gas exchange. But while the pneumatic vest vibrates the alveoli, it does not significantly vibrate the gas being exchanged. Further, the tissue surrounding the chest, such as muscle and fat, dampens the oscillation, thus limiting the amount that the oscillation results in vibration of the alveoli. In addition to being uncomfortable, the pneumatic vest requires an air compressor to pneumatically drive the vest and is thus inconvenient for patients due to its lack of portability. Because of the requirement of an air compressor to drive the vest, they are typically used in hospital or clinical settings.

As an alternative, oral high-frequency oscillation devices have been developed to oscillate the air column and thus the air within the lungs. To give patients the benefit of the oscillating air column, such devices typically also require a ventilator attached to a mask that fits over the patient's face or a tube inserted in a patient's throat to provide a sealed air system. Such devices are thus uncomfortable for patients and inconvenient because a patient cannot eat, drink, or effectively talk while using the ventilator. Additionally, such devices are inconvenient because they require a compressed air source and a motor to produce oscillations that can be superimposed on top of a patient's normal breathing. Further, the effectiveness of such devices is limited because they only vibrate the gas being exchanged and do not directly vibrate the alveoli.

Known respiratory assisting devices have low portability and are invasive, uncomfortable, and expensive. Additionally, no known respiratory assisting device effectively vibrates both the alveoli and the gas being exchanged. There is a need for an improved device that facilitates lung gas exchange.

Embodiments of a lung gas exchange device are described herein by way of example. Those skilled in the art recognize that lung gas exchange devices according to the present invention are not limited to the embodiments or drawings described herein. It should be understood that the drawings and description are not intended to be limited to the particular form disclosed. Rather, the intention is to cover all modifications, equivalents and alternatives falling within the spirit and scope of the disclosed embodiments. Any headings used herein are for organizational purposes only and are not meant to limit the scope of the description or the claims. As used herein, the word "may" is used in a permissive sense (i.e., meaning having the potential to) rather than the mandatory sense (i.e., meaning must). Similarly, the words "include," "including," and "includes" mean including, but not limited to.

DETAILED DESCRIPTION

Embodiments of the present invention provide a device that vibrates a user's, such as a patient's, trachea, thus effectively vibrating both the alveoli and the gas being exchanged to improve lung function. Embodiments include a portable device that may be conveniently and non-invasively affixed to a patient's neck, thus allowing a patient to walk, talk, eat, drink, and perform other routine tasks while having improved lung function. By improving gas exchange with a portable external device, patients with severe respiratory disease will become more active and thereby improve their health.

Figure 10:
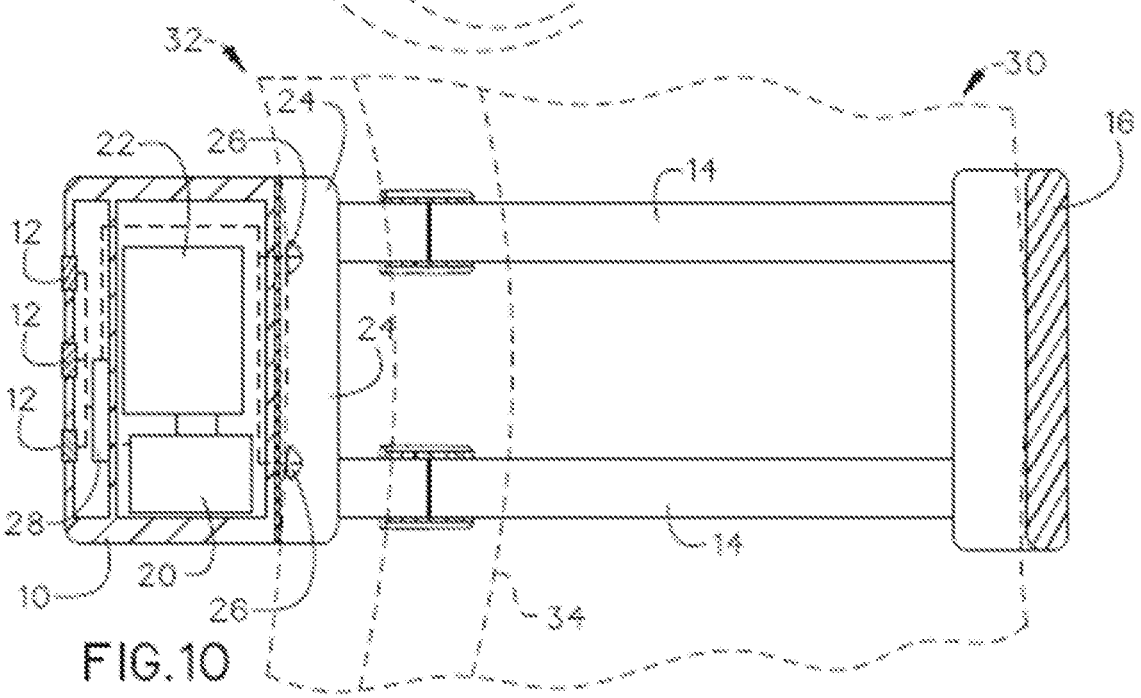
FIG. 10 is a section view of an exemplary embodiment of the present invention along line 10-10 in FIG. 1.
Figure 11:
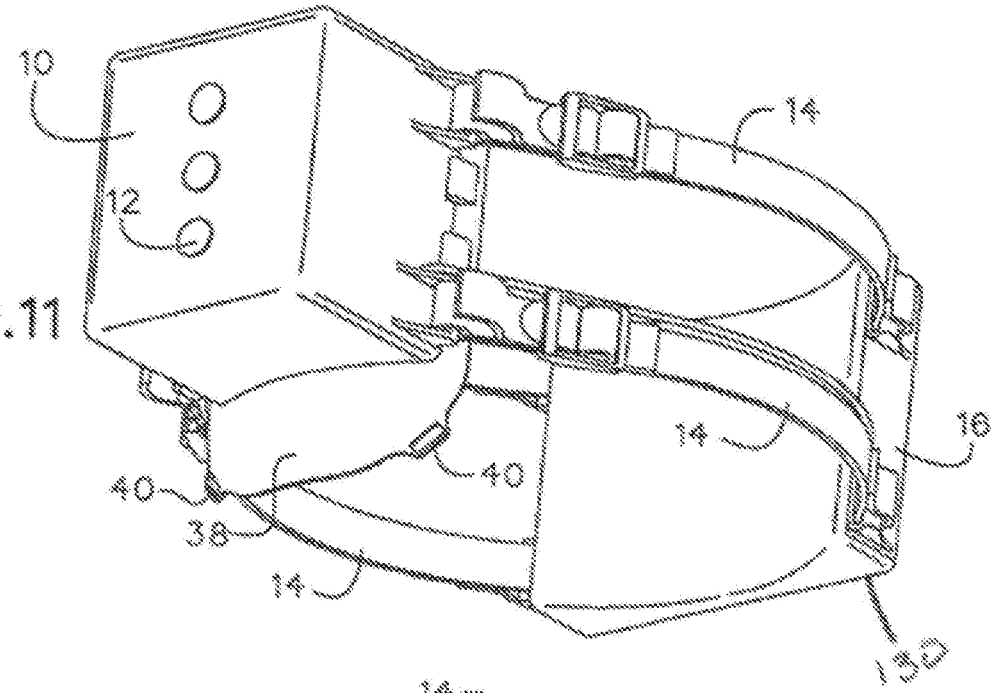
FIG. 11 is a bottom perspective view of an alternate embodiment of the present invention.
Figure 12:
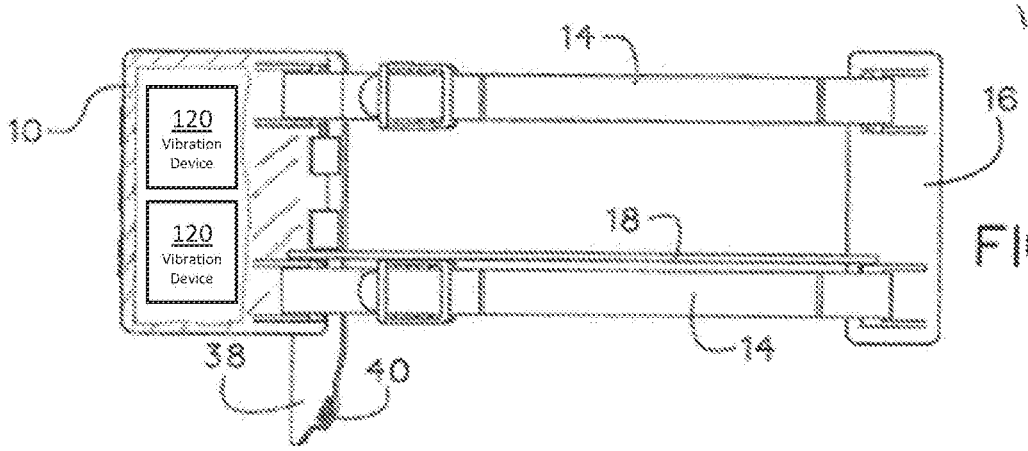
FIG. 12 is a side view of an alternate embodiment of the present invention.
Figure 13:
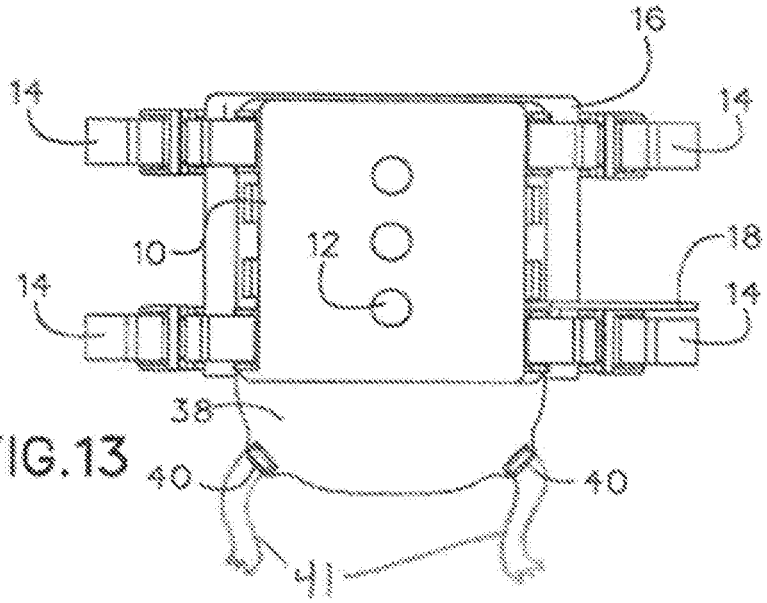
FIG. 13 is a front view of an alternate embodiment of the present invention.

As illustrated in FIGS. 1 through 13, a lung gas exchange device may include a front housing 10 housing a vibrating device and a control mechanism 12. The front housing 10 may include a front side, a rear side, and an interior housing. At least one wear plate 24 may attach to the front housing 10 and be adapted to transfer vibration to a patient's anterior neck 32, as shown in FIG. 10. By placing the wear plate 24 against a patient's anterior neck 32, the trachea 34 may be vibrated. The trachea 34 and lower airways are composed of cartilage and as such are semi-rigid. Thus, by vibrating the trachea 34, the vibrating device may vibrate the airways and the attached alveoli, thereby improving gas exchanged. Additionally, vibrating the trachea 34 vibrates the air column within the trachea 34, thus further improving gas exchange.

The wear plate 34 may be curved and optimally sized to focus vibration on the trachea 34. The wear plate 34 may be patient specific and formed to the contours and length of the patient's neck to maximize transfer of the vibration from the vibrating device to the patient's trachea 34. The wear plate 34 may be securely affixed to front housing 10 and the vibrating device. In some embodiments, the wear plate 34 may be removably affixed to the front housing 10 to allow for attachment of alternative wear plates. The one wear plate 24 may be made from a metal material. Alternatively, the wear plate 24 may be made of a non-rigid, semi-elastic material configured to maintain pressure from the wear plate 24 on the anterior neck of a user. In some embodiments, wear plate 24 may be made from a metal material but covered in a less rigid material to increase comfort for a patient.

The front housing 10 may include at least one control mechanism 12. In certain embodiments, the at least one control mechanism 12 may be one or more buttons. The at least one control mechanism 12 may also include one or more dials or other controls configured to allow for variable adjustments. The at least one control mechanism 12 may be connected to the front side of the front housing 10. The control mechanism 12 may include an on/off control to allow a patient to turn on or turn off the vibration device. The control mechanism 12 may also include controls to allow a user, such as a doctor, to optimally set various aspects of the vibration, such as the frequency and the amplitude. In certain embodiments, control mechanism 12 may also allow a user to control the direction or axis of vibration, or control whether the vibration is periodic, random, or follows a predetermined pattern. In some embodiments, control mechanism 12 may include a single control to allow a user, such as a patient, to turn on and off the vibration device and include an interface, such as a wired or wireless interface, to allow a user, such as a doctor, to optimally tune the vibration device for a patient.

Figure 1:
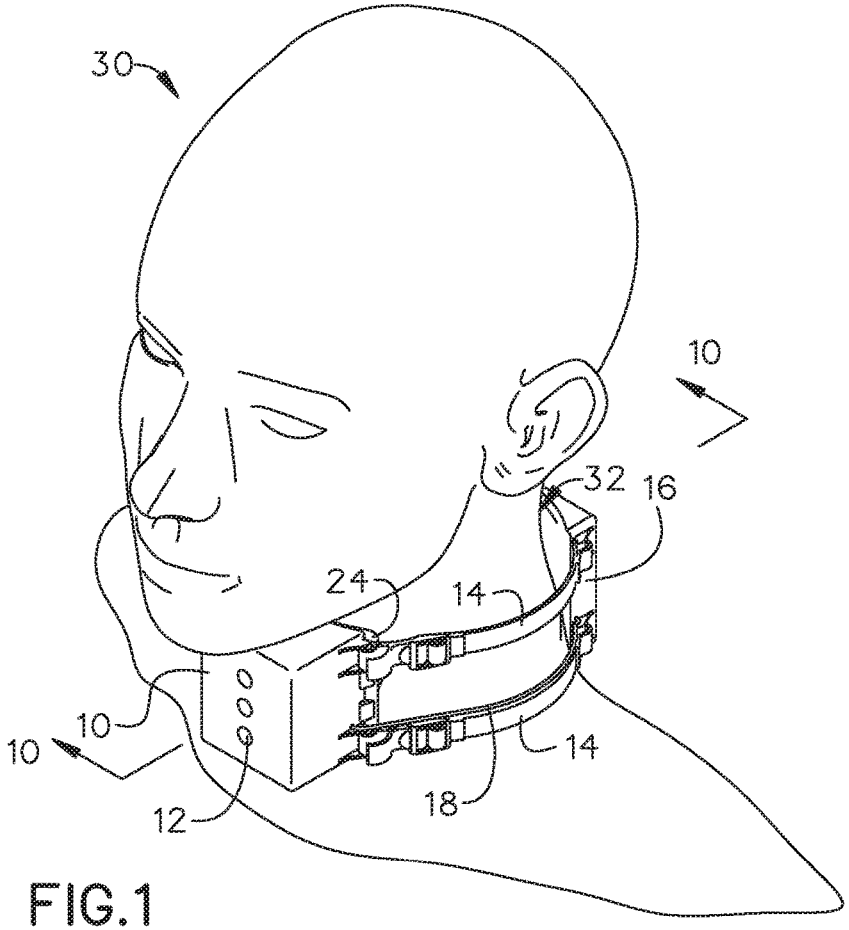
FIG. 1 is a perspective view of an exemplary embodiment of the present invention shown in use.
Figure 2:
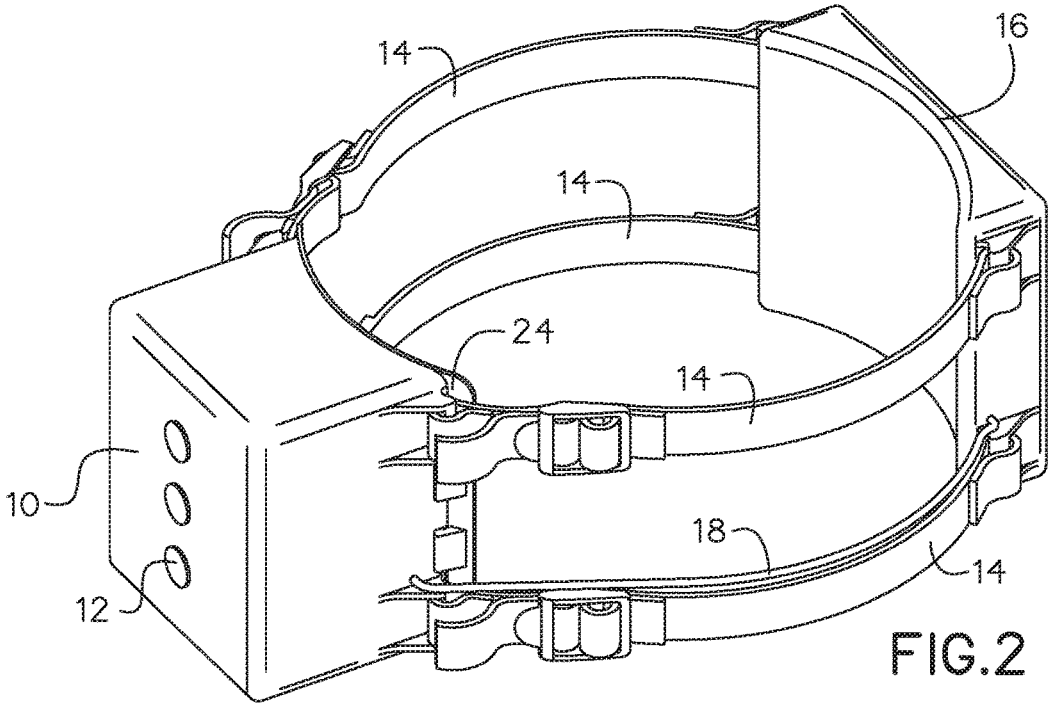
FIG. 2 is a perspective view of an exemplary embodiment of the present invention.
Figure 3:
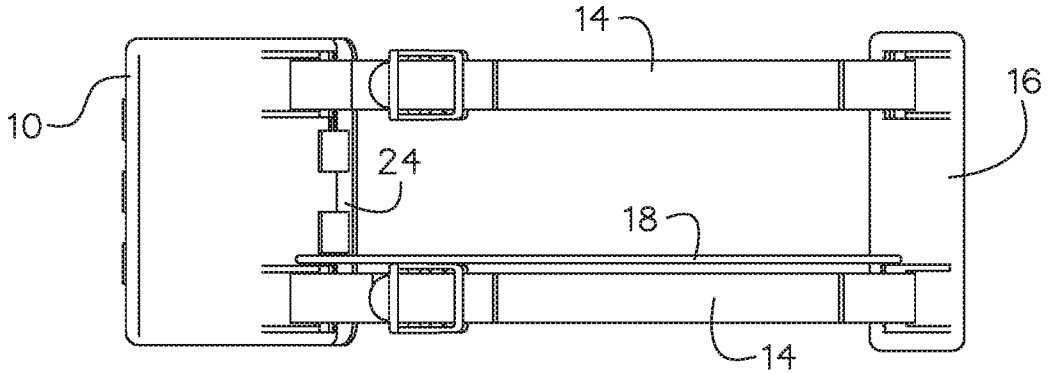
FIG. 3 is a side view of an exemplary embodiment of the present invention.
Figure 4:
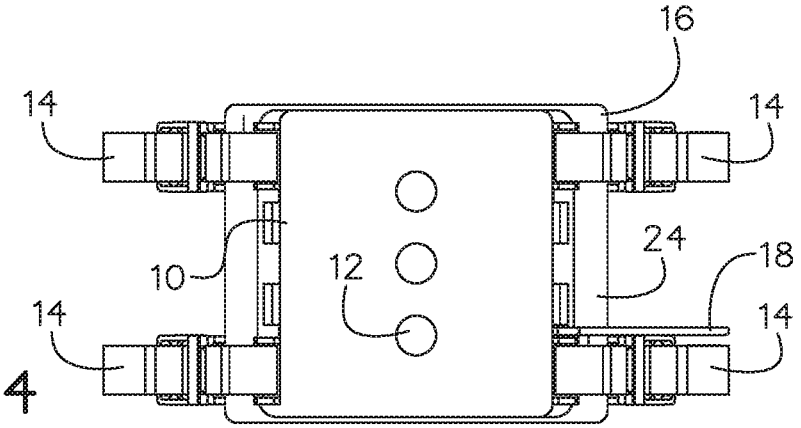
FIG. 4 is a front view of an exemplary embodiment of the present invention.
Figure 5:
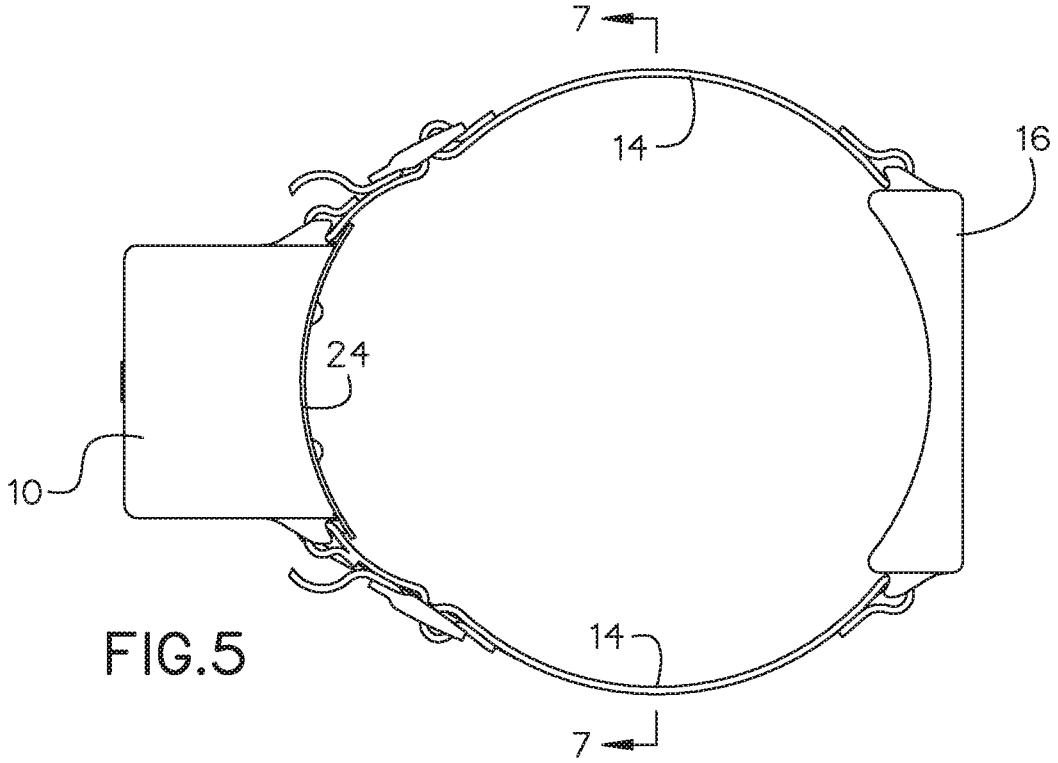
FIG. 5 is a top view of an exemplary embodiment of the present invention.
Figure 6:
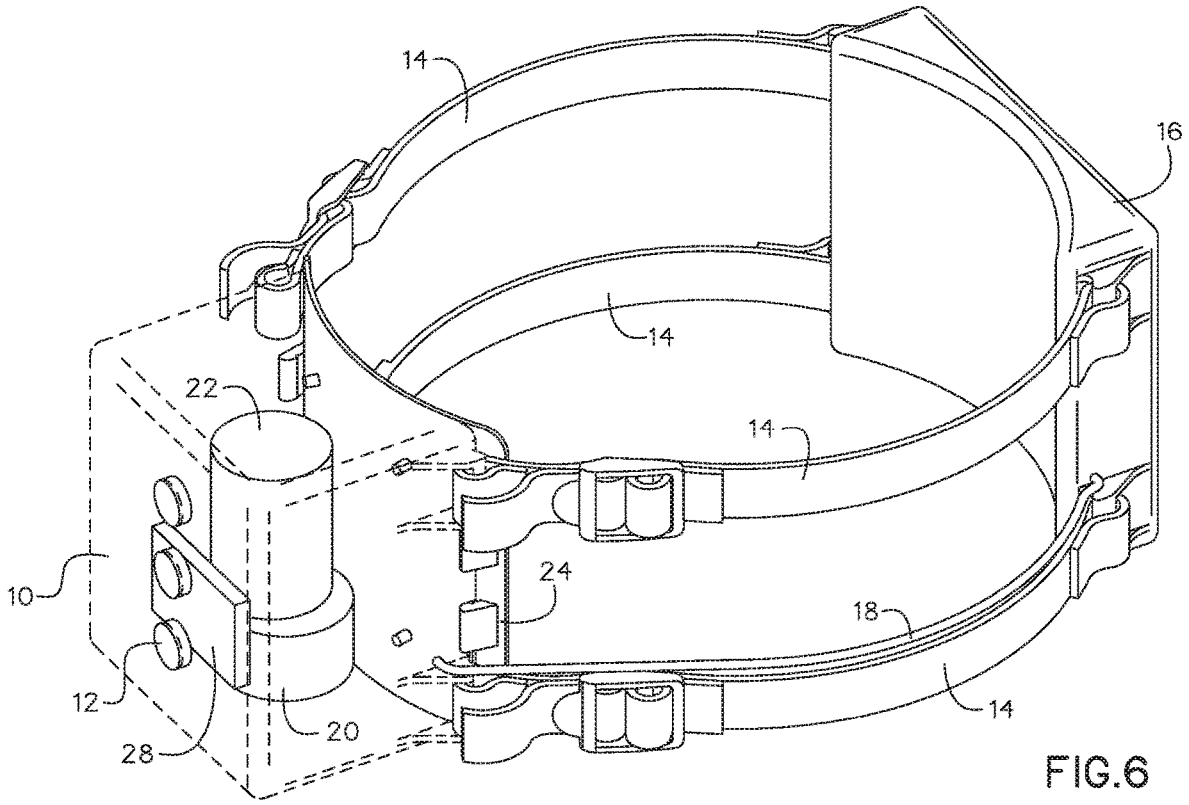
FIG. 6 is a perspective view of an exemplary embodiment of the present invention with a front cover shown in hidden-line for illustrative clarity of inner components.
Figure 7:
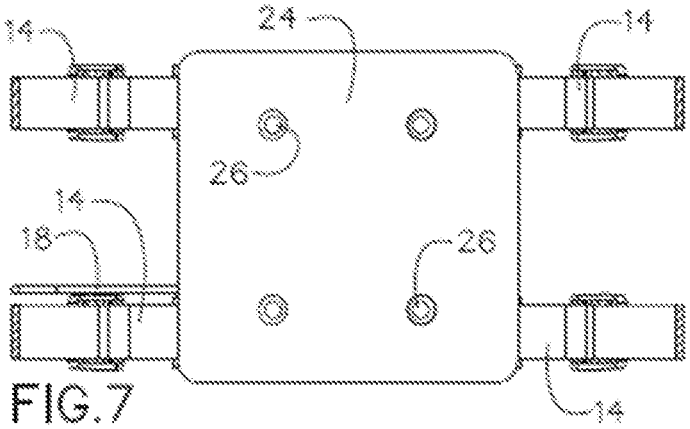
FIG. 7 is a section view of an exemplary embodiment of the present invention along line 7-7 in FIG. 5.
Figure 8:
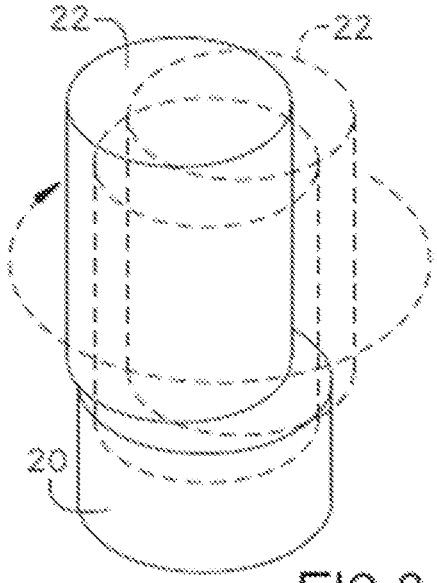
FIG. 8 is a perspective view of a motor and offset weight of an exemplary embodiment of the present invention.
Figure 9:
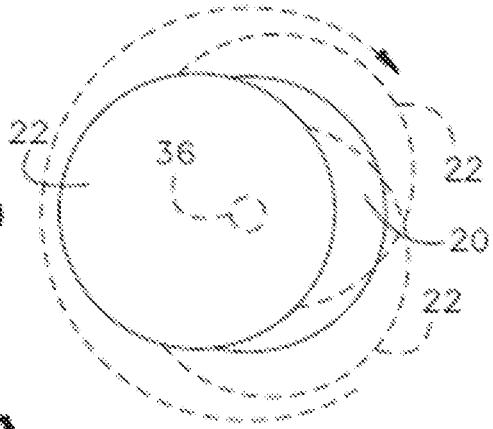
FIG. 9 is a top view of the motor and offset weight of an exemplary embodiment of the present invention.

As shown in FIG. 6, a motor 20 may be housed within the front housing 10. In certain embodiments, an offset weight 22 may be connected to the motor 20 within the interior of the front housing 10. A central processing unit board 28 may be housed within the interior of the front housing 10. At least one wear plate 24 may attach to the front cover 10. In certain embodiments, the wear plate 24 may attach to the rear side of the front cover 10.

At least one sensor 26 may attach to the wear plate 24. The gas exchange device may include one or more of a sensor for measuring a patient's oxygen saturation, carbon dioxide in the blood stream, heart rate, respiratory rate, and temperature. Embodiments may include a memory device 100 configured to store sensor measurements over time and an interface 150, such as a wireless interface, to allow a user, such as a patient or doctor, to access saved sensor measurements. In certain embodiments, the central processing board 28 may include a wireless interface and the gas exchange device may be configured to transmit sensor measurements to an external device, such as a smartphone or personal computer, with software configured to store the sensor data.

Embodiments may also include one or more sensors 26 configured to measure movement, such as sensors for measuring location based on GPS and/or a multi-direction accelerometer. Embodiments including sensors configured to measure movement may also capture data correlating a patient's health parameters, such as heart rate, oxygen saturation, carbon dioxide level, and respiratory rate with their movement.

In certain embodiments, the vibrator may be able to self-adjust to optimize the vibration parameters to enhance vibration and gas exchange dynamically. The central processing board 28 may include feedback controls that use data from the at least one sensor 26 to alter parameters of the vibration device to maintain optimal performance. In such embodiments, central processing board 28 may include a storage device with a vibration parameters map, such as a multi-variable vibration parameters map, to allow vibration parameters to be dynamically selected based on sensor feedback.

Embodiments may include a power source 16 positioned at the posterior or a user's neck. The power source 16 may be attached to the front housing 10 via one or more straps 14. The straps 14 may be configured such that the wear plate 24 exerts firm and consistent pressure on the anterior neck 32. A connecting cable 18 may connect the front housing 10 and the components within and along the front housing 10 to the power source 16. The at least one strap 14 may include a first end and a second end. The first end of the at least one strap 14 may connect to the front cover 10 and the second end of the at least one strap 14 may connect to the power source 16. The power source 16 may be at least one battery. The power source may rest on the back of the neck 32 and serve to counterbalance the vibrator as well as allow for more tracheal contact with the vibrator wear plate and greater power capacity. In alternative embodiments, the power source 16 may be integrated within front housing 10 and both ends of one or more straps 14 may connect to the front cover 10. The power source may also include a power wire, or an adaptor to which a power wire can be connected, to allow for connection to an external power source to allow for longer run time. The external power source may be, for example, an outlet or an extended battery pack. The at least one strap 14 may be connected by fastener or the like.

The motor 20 may be of a variable speed variety. The motor 20 may act like a vibrator, providing a rotary axis 36 while an offset weight 22 may help to provide rotational momentum. Those of skill in the art understand that the vibration device may take alternative forms. For example, alternative embodiments may include linear, rather than rotational, actuation to provide an alternative direction of vibration. Embodiments may also include more than one vibration device, thereby allowing for additional control of the vibration parameters, including the frequency, amplitude, and direction of the vibration. Certain embodiments may include multiple vibration devices each mounted in an orientation selected to provide a desired direction of vibration.

In certain embodiments, additional vibrating wear plate(s) may be added to vibrate a portion of the chest bony wall, for example the sternal notch. By applying vibration directly to the bony chest wall, as opposed to the exterior of the chest where users typically have greater tissue mass, embodiments may further increase vibration of the alveoli to further improve gas transfer. An extended wear plate 38 may conform to the part of or the entire chest. In certain embodiments, at least one extended wear plate 38 may be used instead of the at least one wear plate 24. A strap loop 40 may be used with the at least one extended wear plate 38 to help secure the at least one extended wear plate 38 in the proper location. For example, straps 41 attached to strap loop 40 may extend under a user's armpits and around a user's back such that two ends of a strap attach to the strap loops 40 shown in FIG. 11. Embodiments including at least one extended wear plate 38 may have one or more additional vibration device that may be configured to transfer vibration to just the at least one extended wear plate 38. Embodiments may include one or more control mechanisms configured to control the extended wear plate 38 independently from the wear plate 24.

In certain embodiments, the posterior battery pack serves and may be constructed as to counterweight to the vibrator portion to maintain wear plate pressure against the anterior neck and chest. Additionally, there may be additional weight (s) and/or components added to the posterior compartment 130 if the battery weight is not sufficient.

It should be understood that the foregoing relates to exemplary embodiments of the invention and that modifications may be made without departing from the spirit and scope of the invention as set forth in the following claims.

What is claimed is:

1. A lung gas exchange device, comprising:

a front housing comprising a top end and a bottom end;

a vibration device positioned within the front housing;

an extended wear plate attached to the front housing and extending beyond the bottom end of the front housing, the extended wear plate being configured to vibrate a column of air by transferring vibration from the vibration device to the patient, and the extended wear plate being configured to conform to a chest of the patient such that vibration is transferred to the chest of the patient;

a power source configured to provide power to the vibration device, the power source coupled to the front housing and the extended wear plate by a certain distance such that the power source is configured to conform to the patient's back when the extended wear plate is configured to conform to the chest of the patient, the power source being attached to a compartment; and a central processing unit board connected to the power source and the vibration device, the central processing unit board being configured to maintain optimal performance of the lung exchange device, wherein the compartment is configured to add counterweight to the vibration device such that when transferring vibration from the vibration device to the chest of the patient, the extended wear plate puts pressure against the chest of patient.

2. The lung gas exchange device of claim 1, wherein the extended wear plate is configured to be adapted to the contours of the patient's chest.

3. The lung gas exchange device of claim 1, wherein the extended wear plate is removably affixed to the front housing.

4. The lung gas exchange device of claim 1, wherein the power source comprises a battery.

5. The lung gas exchange device of claim 1, wherein the extended wear plate is made from a metal material and covered in a less rigid material.

6. The lung gas exchange device of claim 1, wherein the extended wear plate is made from a non-rigid, semi-elastic material.

7. The lung gas exchange device of claim 6, wherein the extended wear plate is configured to maintain pressure from the extended wear plate on the chest of patient.

8. The lung gas exchange device of claim 1, further comprising at least one sensor attached to the extended wear plate.

9. The lung gas exchange device of claim 8, wherein the at least one sensor includes at least one sensor configured for measuring at least one of the patient's (a) oxygen saturation, (b) carbon dioxide in the blood stream, (c) heart rate, (d), respiratory rate, and (e) temperature.

10. The lung gas exchange device of claim 9, wherein in response to signals received from the at least one sensor, the central processing unit board is configured to alter one or more parameters of the vibration device.

11. The lung gas exchange device of claim 10, further comprising a storage device, wherein the storage device stores a vibration parameters map, and wherein the central processing unit board is configured to dynamically select parameters for the vibration device from the vibration parameters map based on one or more measurement received from the at least one sensor.

12. The lung gas exchange device of claim 11, further comprising one or more sensors for measuring movement, including at least a sensor for measuring location based on GPS and an accelerometer.

13. The lung gas exchange device of claim 1, further comprising a plurality of sensors attached to the extended wear plate configured for measuring each of the patient's (a) oxygen saturation, (b) carbon dioxide in the blood stream, (c) heart rate, (d), respiratory rate, and (e) temperature.

14. The lung gas exchange device of claim 13, wherein the central processing unit board is configured to alter one or more parameters of the vibration device in response to signals received from the plurality of sensors.

15. The lung gas exchange device of claim 13, further comprising a storage device, wherein the storage device stores a vibration parameters map, and wherein the central processing unit board is configured to dynamically select parameters for the vibration device from the vibration parameters map based on one or more measurement received from the plurality of sensors.

16. The lung gas exchange device of claim 1, wherein the extended wear plate is configured to transfer vibration from the vibration device to a chest wall of the patient.

17. The lung gas exchange device of claim 16, wherein the extended wear plate is configured to transfer vibration from the vibration device to a portion of the chest wall of the patient.

18. The lung gas exchange device of claim 17, wherein the wear plate is configured to conform to a part of the chest of the patient.

* * * * *